US006474635B2

(12) United States Patent
Ruf et al.

(10) Patent No.: US 6,474,635 B2
(45) Date of Patent: Nov. 5, 2002

(54) CARTON UNLOADING AND ERECTING APPARATUS

(75) Inventors: Reinhold Ruf, Laupheim (DE); Wolfgang Rodi, Laupheim (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 0 days.

(21) Appl. No.: 09/902,621

(22) Filed: Jul. 11, 2001

(65) Prior Publication Data

US 2002/0028737 A1 Mar. 7, 2002

(30) Foreign Application Priority Data

Jul. 13, 2000 (DE) ..... 100 34 140

(51) Int. Cl.[7] ..... B65H 5/08; B31B 3/12

(52) U.S. Cl. ..... 271/12; 271/99; 271/107; 493/313; 493/317; 414/797.8

(58) Field of Search ..... 53/457, 458, 381.1; 493/313, 317; 414/797.8, 798.2; 271/1, 11, 12, 107, 99; 220/268

(56) References Cited

U.S. PATENT DOCUMENTS 4,194,442 A * 3/1980 Martelli ..... 414/797.8
4,518,301 A * 5/1985 Greenwell ..... 414/797.8
4,854,930 A * 8/1989 Miselli et al. ..... 493/317
4,871,348 A 10/1989 Konaka
5,054,761 A * 10/1991 Dietrich et al. ..... 271/12
5,456,381 A 10/1995 Fochler
5,715,657 A 2/1998 Mondani
5,813,965 A * 9/1998 Mitchell et al. ..... 271/99

FOREIGN PATENT DOCUMENTS

| | | |
|---|---|---|
| DE | 2923909 | 12/1980 |
| DE | 3727034 | 6/1988 |
| DE | 4314696 | 11/1994 |
| DE | 19914578 | 10/2000 |

* cited by examiner

*Primary Examiner*—H. Grant Skaggs
(74) *Attorney, Agent, or Firm*—Herbert Dubno; Andrew Wilford

(57) ABSTRACT

An unloading and erecting apparatus has a frame fixed to a magazine holding a stack of flattened cartons, an outer horizontal guide on the frame, an outer horizontal slide horizontally displaceable on the outer horizontal guide and carrying a nonstraight outer vertical guide. A drive motor connected to the outer horizontal slide horizontally displaces same. A vertical guide on the frame carries a vertical slide and another drive motor connected to the vertical slide vertically displaces same. A shaft pivotal about a generally horizontal axis transverse to the forward direction on the vertical slide is fixed horizontally relative to the outer horizontal slide. A gripper fixed on and angularly displaceable with the shaft is engageable with the frontmost carton of the stack and carries a lever angularly coupled to the gripper and having offset from the axis a follower engaged in the vertical guide of the outer slide for, on vertical movement of the vertical slide, pivoting the gripper between a pick-off position engageable with the frontmost carton and a drop-off position directed downwardly above the conveyor.

9 Claims, 20 Drawing Sheets

CARTON UNLOADING AND ERECTING APPARATUS

FIELD OF THE INVENTION

The present invention relates to a carton unloading and erecting apparatus. More particularly this invention concerns a system for taking a flat box blank out of a supply, erecting it, and setting it on a conveyor leading to a filling or further handling device.

BACKGROUND OF THE INVENTION

Packing cartons are typically produced off site and delivered to the location where they are used in flattened condition in stacks. Before being used the cartons must be separated from the stack and erected, that is transformed from the flattened basically planar shape to an erect three-dimensional and normally parallepipedal shape.

Typically the stack of flattened cartons is loaded into a supply magazine having an outlet end that is formed with narrow retaining lips. The stack is pushed against the lips which are big enough to prevent the stack from moving outward out of the magazine. A suction gripper is normally engaged against the frontmost carton of the stack and moves outward to pull it past the retaining lips, then pivots around to set the carton on an erector or on a conveyor taking the erect box to a further treatment station, for instant a filling device.

In U.S. Pat. No. 5,456,381 a supply magazine holds a stack of flattened cartons in which the cartons extend in respective parallel planes and where the stack has an end formed by a frontmost carton . A device for picking the cartons off the stack starting with the frontmost carton includes a grab displaceable along a path passing through a pickup point and operable when at the point to engage and grip the frontmost carton, and a system for displacing the path and thereby moving the location along a generally straight line for setting the picker for cartons of different height. The carton-supply system has a stationary support adjacent the grab path, a supply magazine having a plurality of guide elements extending parallel to a predetermined feed direction and holding the stack of cartons with their planes substantially perpendicular to the feed direction and with the plane of the frontmost carton defining a predetermined acute pickoff angle with the line of the grab, and an adjustment system supporting the magazine guide elements on the support for straight-line movement in an adjustment direction forming with the feed direction an angle equal to generally half of the pickoff angle and for arresting the magazine in any of a multiplicity of positions offset from each other in the adjustment direction.

This arrangement is extremely effective with respect to adapting to cartons of different sizes. The adjustment requires that the supply magazine be made vertically adjustable which complicates the equipment.

In another known system described in U.S. Pat. No. 4,871,348 the carton delivery apparatus removes cartons, one by one, which are already scored and stored in a stack in a magazine, folded down flat against each other. A suction mechanism removes cartons one by one from the magazine by holding and delivering it to a conveyor. The suction mechanism is mounted on a member which is rotatable about a horizontal shaft disposed between the magazine and the conveyor. The suction mechanism is also rockable about a support shaft which is mounted on the member so that, as the member rotates, the suction mechanism removes a carton and delivers it to the conveyor while holding it on its lower side. Once again, this system requires that the supply magazine's position be adjusted when the carton size changes. Such construction is particularly troublesome in that the equipment is very complex and often fits together with little extra room.

OBJECTS OF THE INVENTION

It is therefore an object of the present invention to provide an improved unloading and erecting apparatus for cartons.

Another object is the provision of such an improved unloading and erecting apparatus for cartons which overcomes the above-given disadvantages, that is which allows carton format to be changed without having to make any position changes to the supply chute or magazine.

SUMMARY OF THE INVENTION

These objects are attained in a system used in combination with a magazine holding a stack of flattened cartons with the cartons extending in respective parallel and generally vertical planes and the stack having an end formed by a frontmost carton and a conveyor below the magazine and adapted to carry off erected cartons in a forward transport direction. The unloading and erecting apparatus according to the invention has a frame fixed to the magazine adjacent the conveyor, an outer horizontal guide on the frame, an outer horizontal slide horizontally displaceable on the outer horizontal guide in the forward direction and in an opposite backward direction and carrying two differently shaped and nonstraight outer vertical guides, and a drive motor connected to the outer horizontal slide for horizontally displacing same on the outer horizontal guide. A vertical guide on the frame carries a vertical slide and another drive motor connected to the vertical slide vertically displaces same on the vertical frame guide. A shaft pivotal about a generally horizontal axis transverse to the forward direction on the vertical slide is fixed horizontally relative to the outer horizontal slide. A gripper fixed on and angularly displaceable with the shaft is engageable with the frontmost carton and carries a lever angularly coupled to the gripper and having offset from the axis two respective followers engaged in the vertical guides of the outer slide for, on vertical movement of the vertical slide, pivoting the gripper between a pick-off position engageable with the frontmost carton and a drop-off position directed downwardly above the conveyor.

Thus with this system the supply magazine does not have to be adjustable, but can be fixed relative to the frame of the unloading and erecting apparatus. When carton size is changed, it is the movement of the gripper that is varied, something that can be handled by the controller for the gripper drives. In fact normally only the vertical displacement has to be varied when carton size is changed. The frontmost carton is pulled straight out of the magazine, that is parallel to its walls, and then the carton, once it is completely free of the magazine, is then pivoted about the axis of the shaft and at the same time this axis can be moved horizontally and/or vertically so that, when the gripper is pivoted around to set the carton down on the conveyor, it is at the required height. With this system the horizontal position of the pivot axis is independent of the vertical position, making adaptation to different sizes very easy.

According to the invention the nonstraight outer vertical guides are shaped such that on vertical movement of the vertical slide the followers are alternately effective to pivot the shaft. This allows the shaft to pivot through a relatively great angle at the first stages of downward movement and the balance later. Such movement allows the structure to be very compact and the space within which the carton is moved to be kept very small also.

The magazine according to the invention is angled downward at an acute angle to the horizontal and the forward direction is horizontal. The shaft pivots through more than 90° on movement between the take-off position and drop-off position.

In order to increase the reliability of the equipment, it further has according to the invention an inner horizontal guide on the vertical slide, an inner horizontal slide horizontally displaceable on the inner horizontal guide in the forward and backward directions relative to the vertical slide, and link means coupling the inner and outer horizontal slides together for joint horizontal movement. This link means can be a vertical guide track on the outer slide and a follower fixed horizontally relative to the inner horizontal slide and engaged therein.

The carton-unloading and -erecting apparatus further has according to the invention a stationary abutment underneath the magazine at an upstream end of the conveyor and positioned to engage a carton moved by the gripper between the take-off position and the drop-off position. In addition it has a horizontal hold-down guide extending above the conveyor downstream of an upper end thereof so that cartons on the conveyor are held down thereagainst by the hold-down guide. Each of the nonstraight vertical guides has a vertical and straight lower section and each of the nonstraight vertical guides has a vertical and straight upper section.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
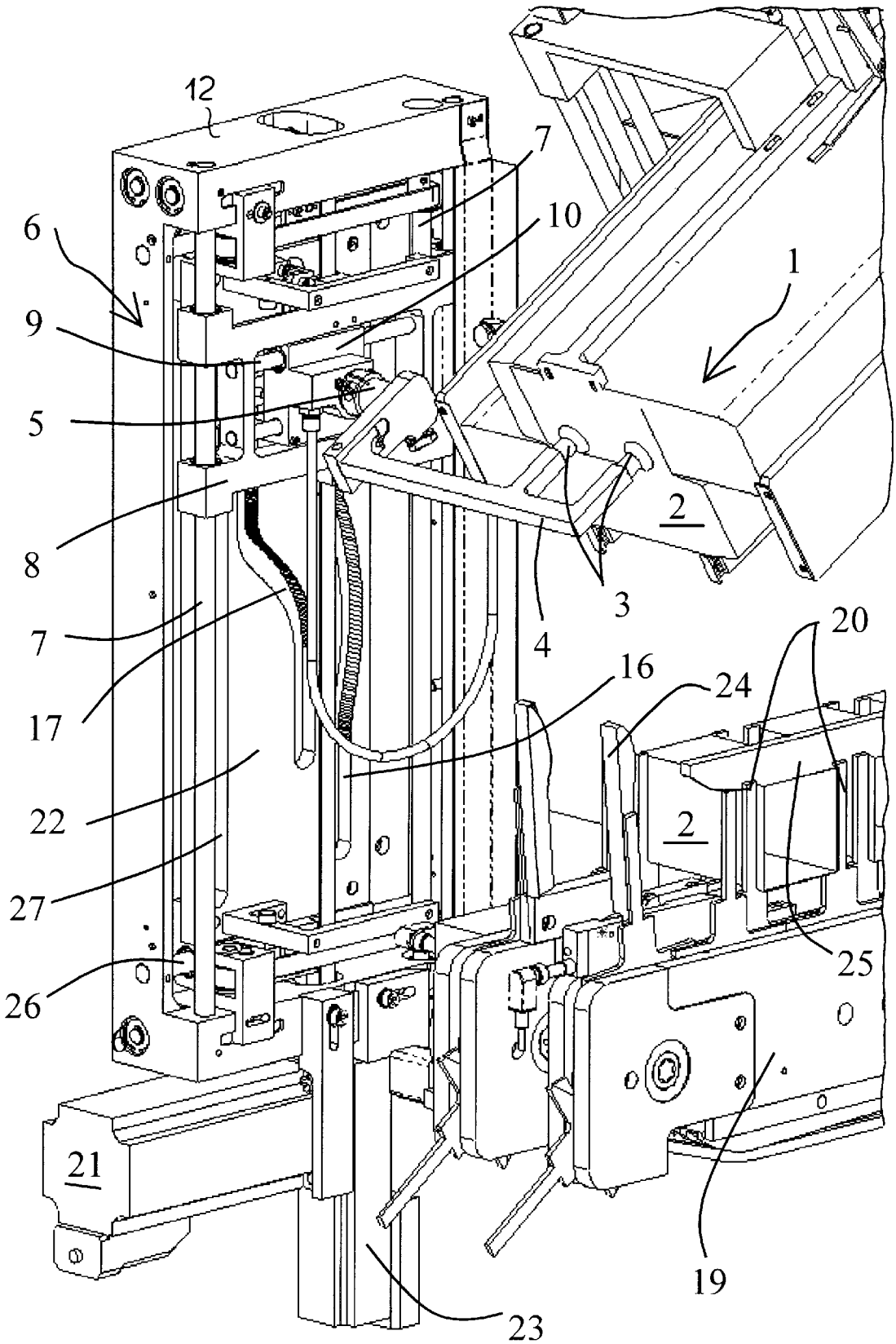
FIG. 1 is perspective view of the unloading/erecting apparatus according to the invention along with the supply magazine and output conveyor.
Figure 2:
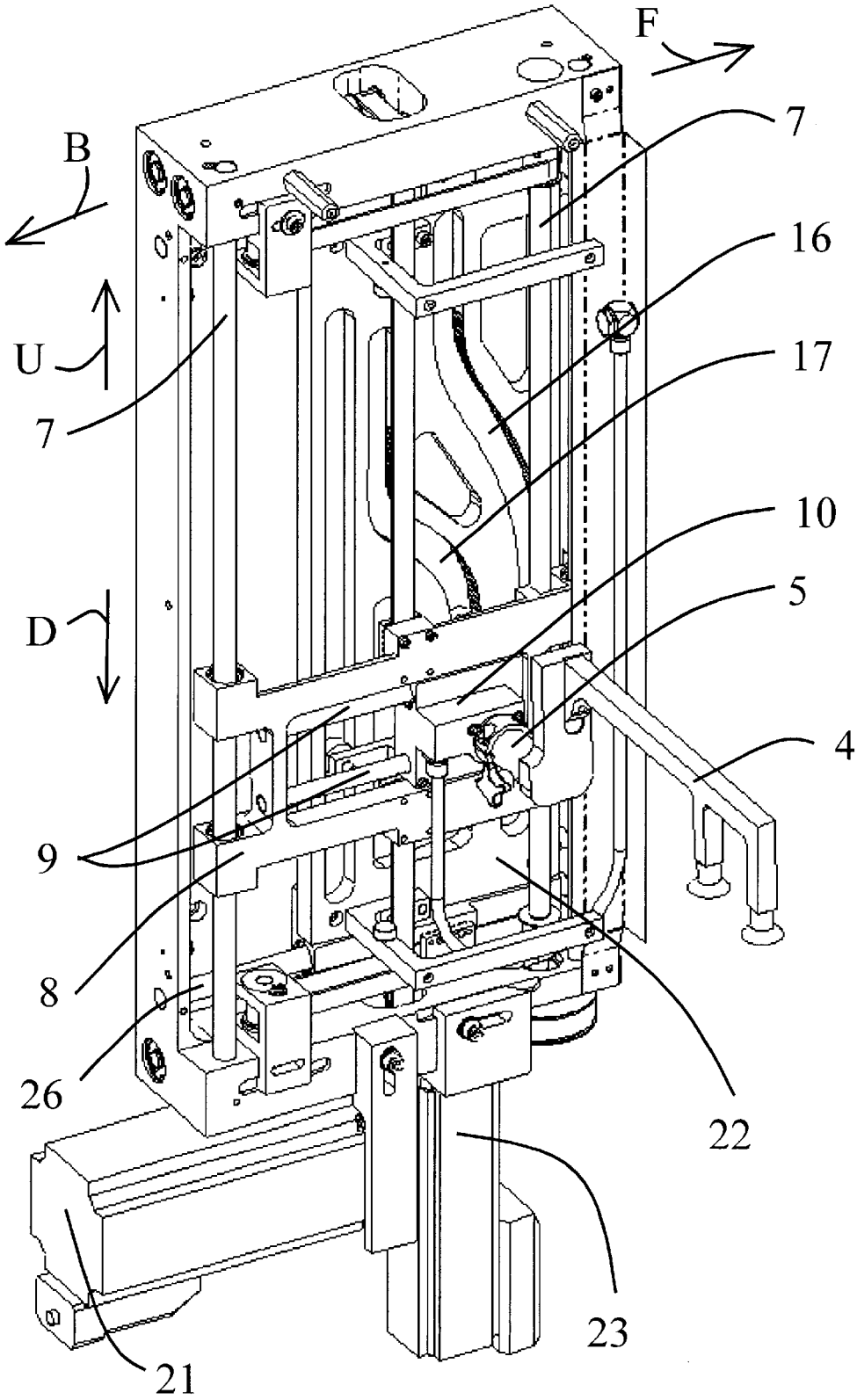
FIG. 2 is a perspective view of only the unloading/erecting apparatus according to the invention.
Figure 3:
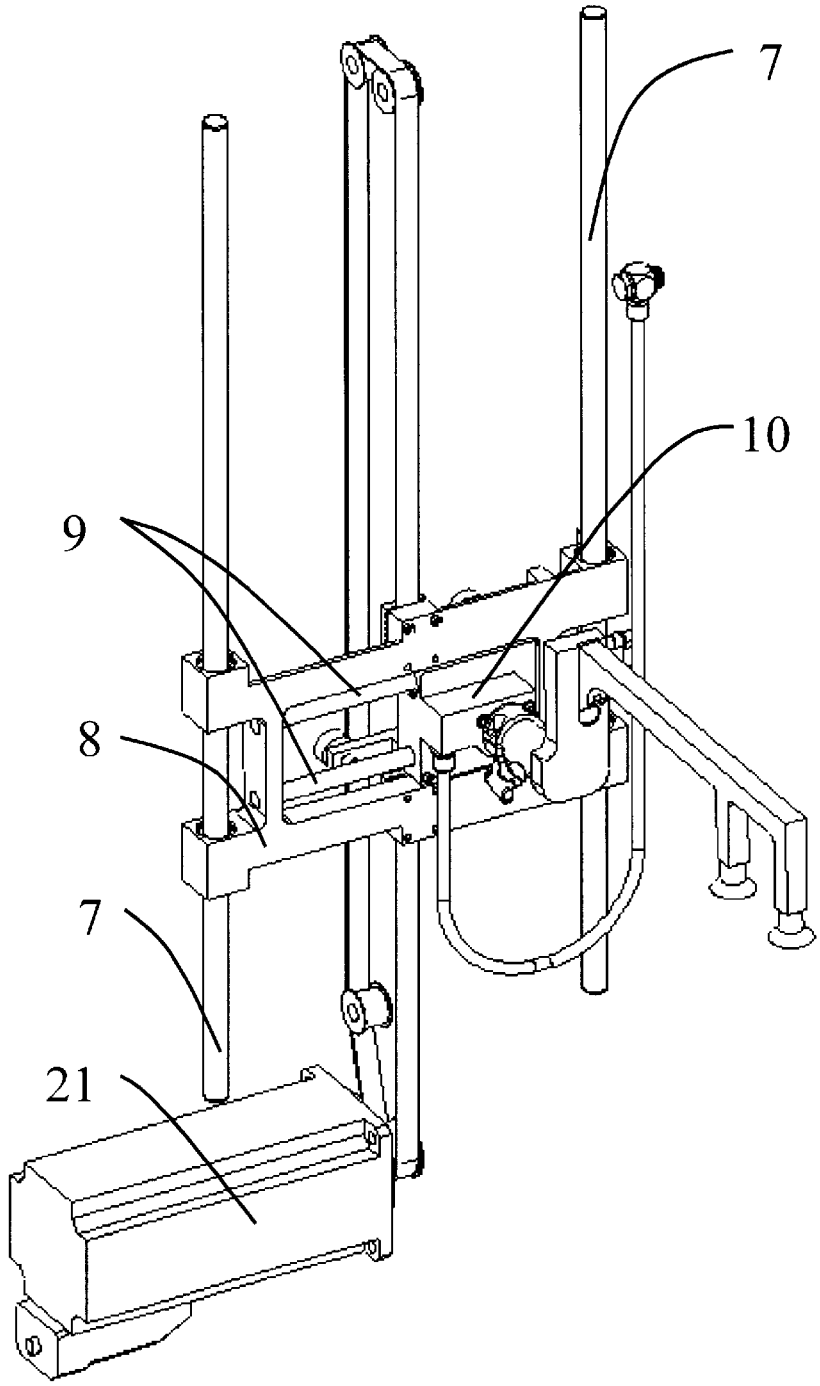
FIG. 3 is a perspective view of the vertical slide and outer horizontal slide.
Figure 4:
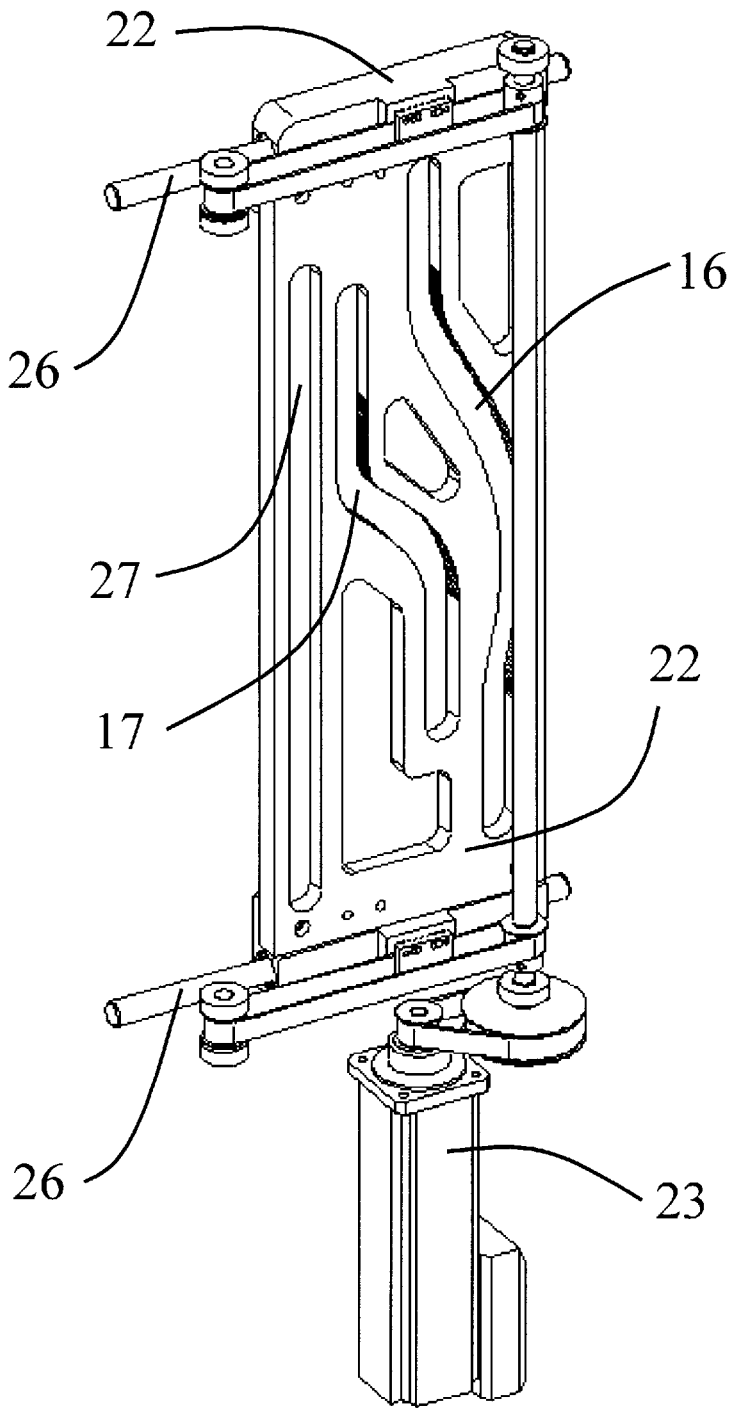
FIG. 4 is a perspective view of the inner horizontal slide.

As seen in FIGS. 1 and 2 a magazine 1 extending at about 30° to the horizontal and opening downward holds a stack of identical flattened carton blanks 2. Grippers 3 are carried on an arm 4 rotatable about a horizontal axis A of a shaft 5 on a subassembly 6 movable vertically (directions U and D) and horizontally (directions F and B) on a stationary machine frame 12 adjacent the stationary magazine 1. The subassembly 6 comprises a vertical slide 8 (see also FIGS. 2 and 3) displaceable on stationary vertical guide rods 7, a horizontal outer slide 22 displaceable on stationary horizontal guide rods 26 (FIG. 4) and linked to the vertical slide 8, and an inner horizontal slide 10 movable on horizontal guides 9 of the vertical slide 8. A separate drive motor 21 (FIG. 3) is connected via a belt drive to the vertical slide 8 to move it along its guides 7 in the up and down directions U and D and another electric motor 23 (FIG. 4) is connected via a belt drive to the outer horizontal slide 22 to move it in the forward and backward directions F and B.

Underneath the supply magazine 1 is a chain- or belt-type conveyor 19 having arms 20 intended to hold erected blanks 2 and carry them off in the forward direction F. Stationary horizontal guides or abutments 25 provided above the conveyor 19 keep the erected blanks 2 down in the cells formed by the arms 20. Upright stationary guides or abutments 24 at the upstream end of the conveyor 2 coact with the grippers 3 to erect the blanks 2 as described in more below.

Figure 5:
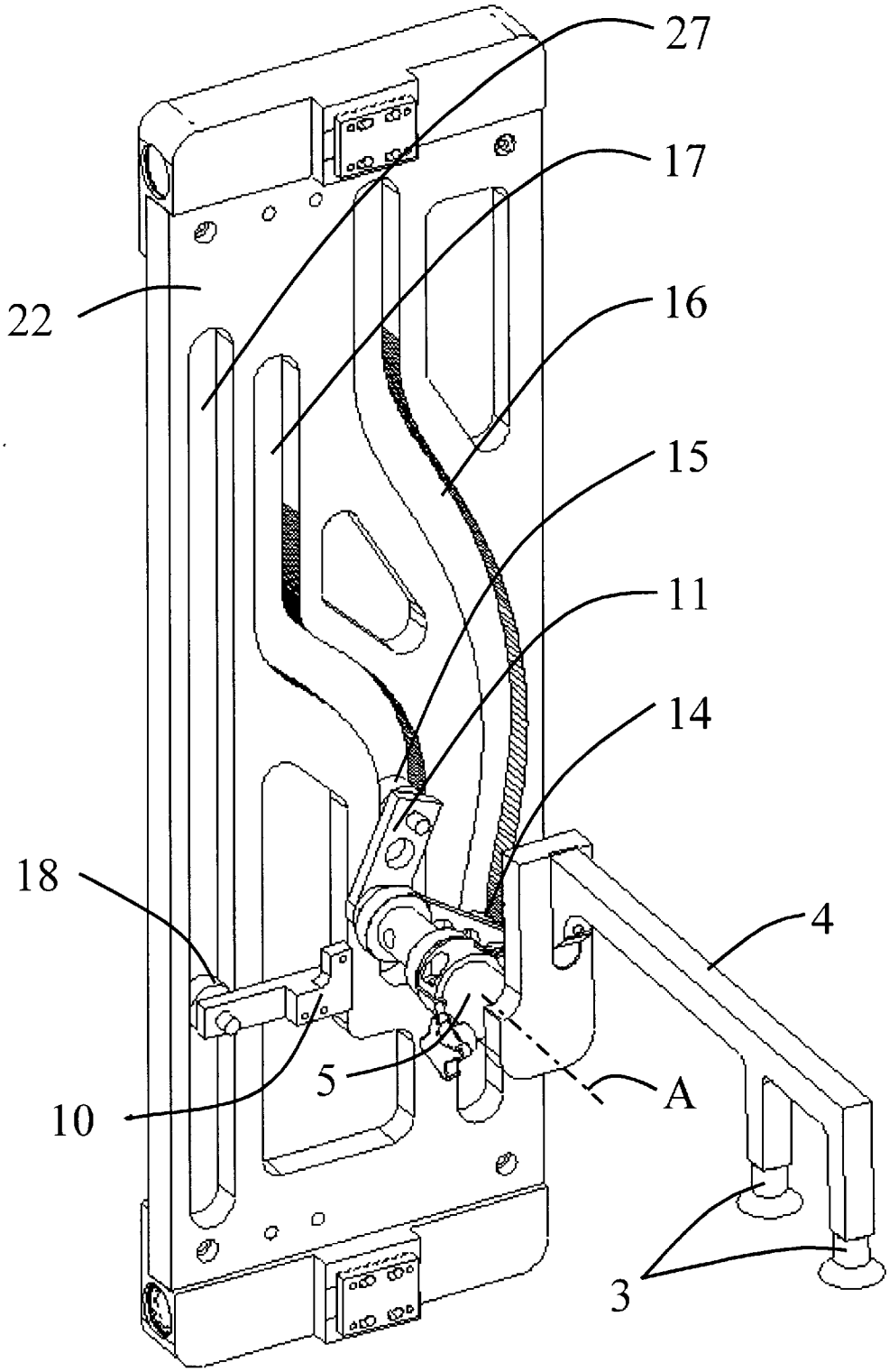
FIG. 5 is a perspective view of the inner horizontal slide and elements of the vertical slide and gripper.
Figure 6:
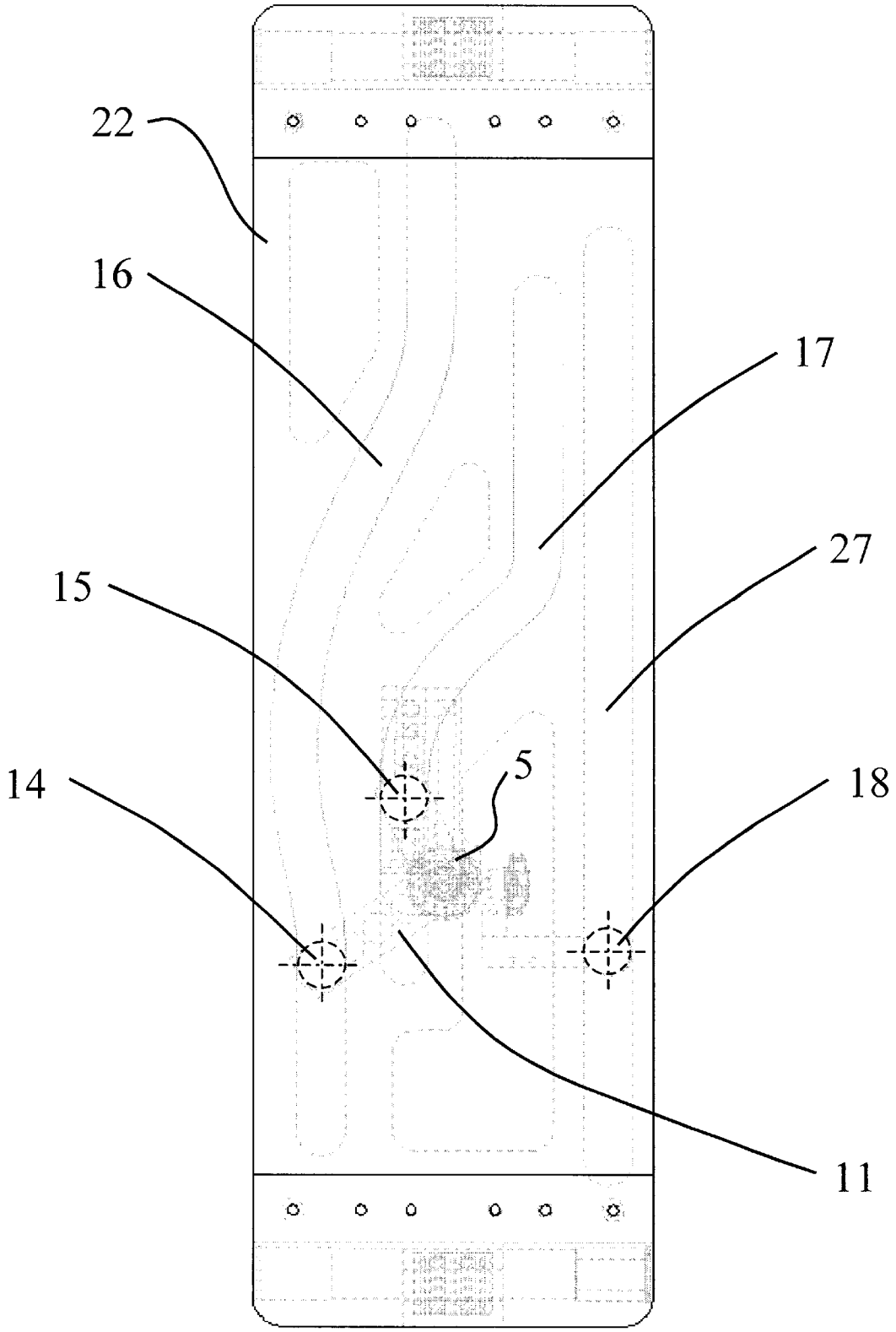
FIG. 6 is a back view of the vertical slide.

The outer horizontal slide 22 as shown in FIG. 6 is a vertically oriented plate extending in a plane parallel to the directions F and B. It is formed with three generally vertically extending slots 16, 17, and 27 constituting guide tracks. The slots 16 and 17 are nonstraight and the slot 27 is perfectly straight and vertical. FIG. 5 shows how the outer horizontal slide 10 which carries the shaft 5 for the arm 4 is provided with a roller 18 which rides in the guide slot 27 so that the outer horizontal slide 10 is horizontally fixed relative to the inner horizontal slide 22. The shaft 5 for the arm 4 carries a two-arm lever 11 carrying a roller 14 in the track slot 16 and a roller 15 offset vertically and horizontally therefrom in the track slot 17, both follower rollers 14 and 15 being offset from the shaft 5 and from each other. Thus as the drive 21 moves the vertical slide 8 to displace either of the follower rollers 14 or 15 in the central nonstraight part of its guide track 16 or 17, the shaft 5 will rotate about the axis A.

The position of the grippers 3 relative to the forward and back directions F and B is determined wholly by the drive 23 which moves the inner and outer horizontal slides 22 and 10 jointly. The angular and vertical positions of the grippers 3 are changed synchronously by the motor 21 which vertically displaces the slides 8 and 10 along the respective guides 7 and 9 and with them the axis A, while also causing the shaft 5 to rotate about its axis A.

Figure 7:
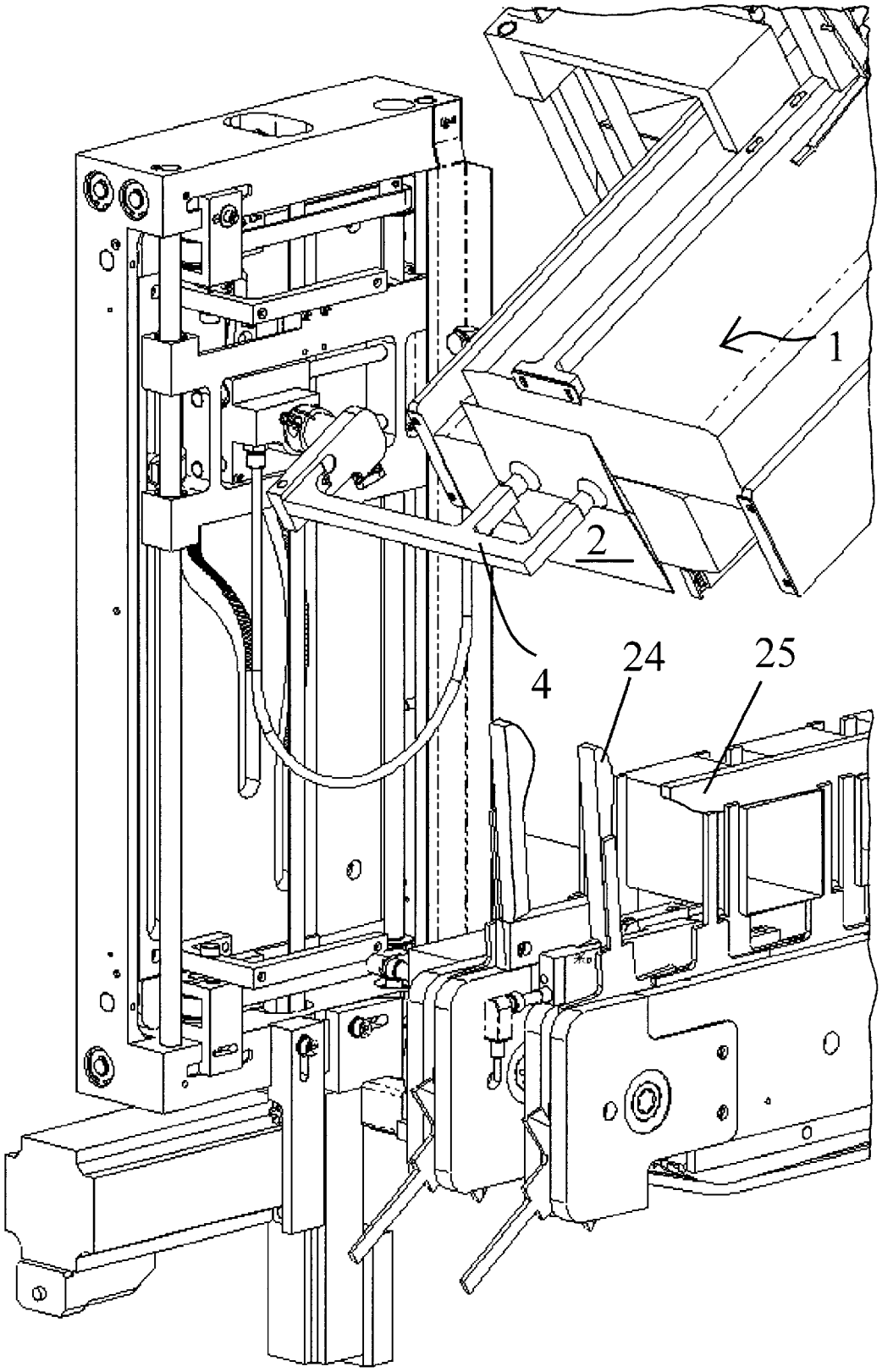
FIGS. 7 through 13 are views like FIG. 1 showing the apparatus in successive operational positions.
Figure 8:
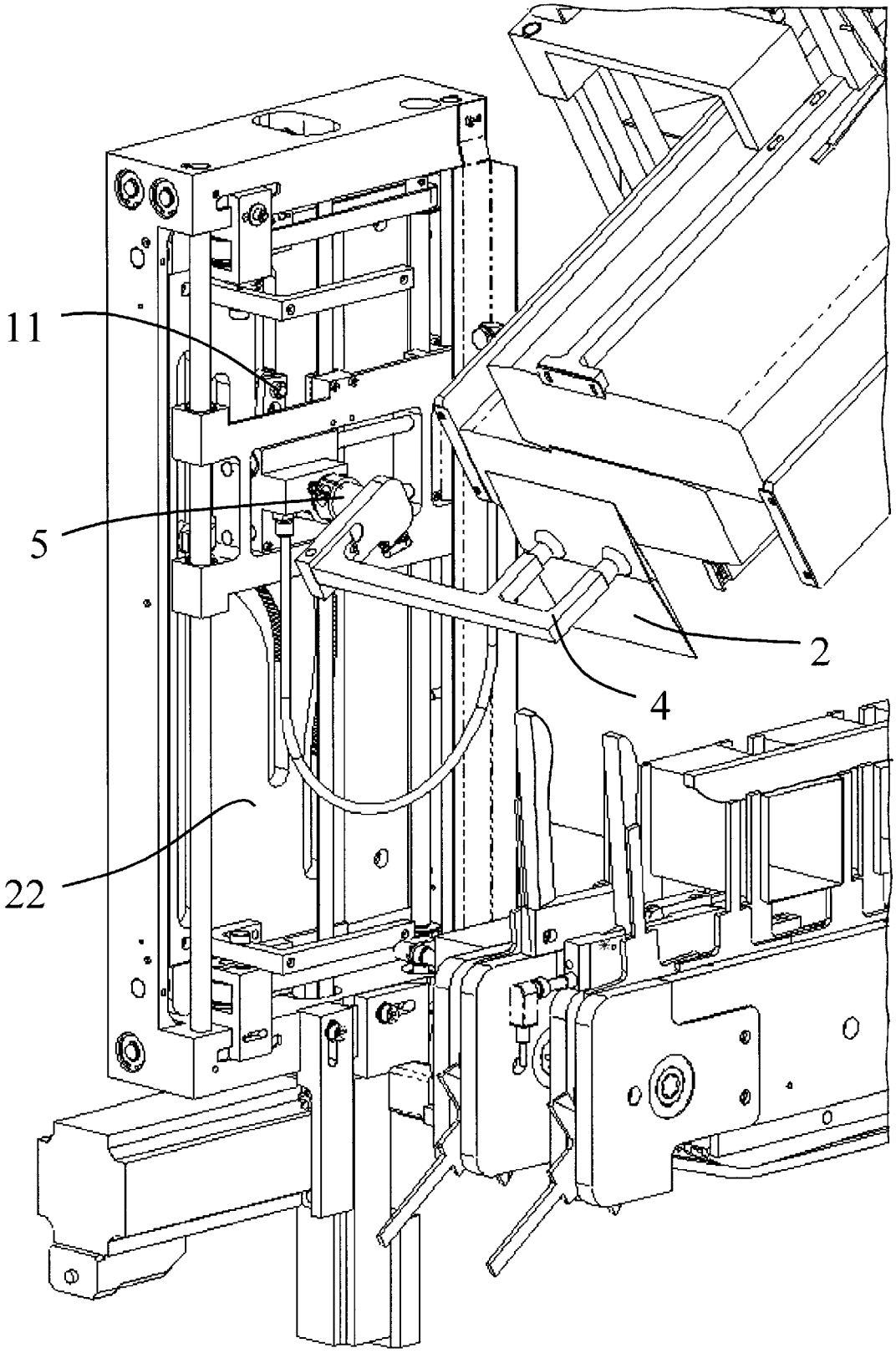
Figure 14:
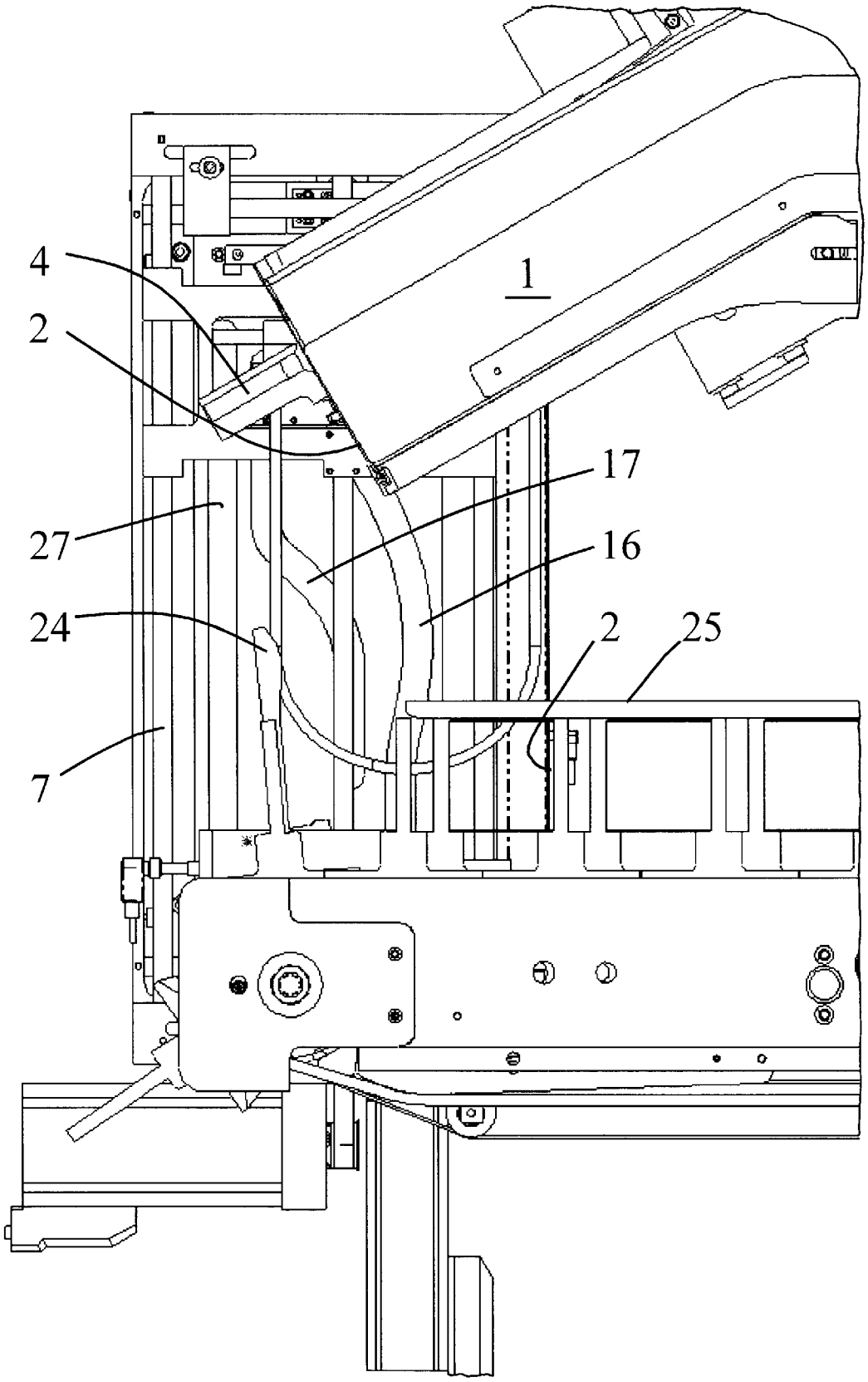
FIGS. 14 through 20 are side views corresponding to the positions of respective FIGS. 7 through 13.
Figure 15:
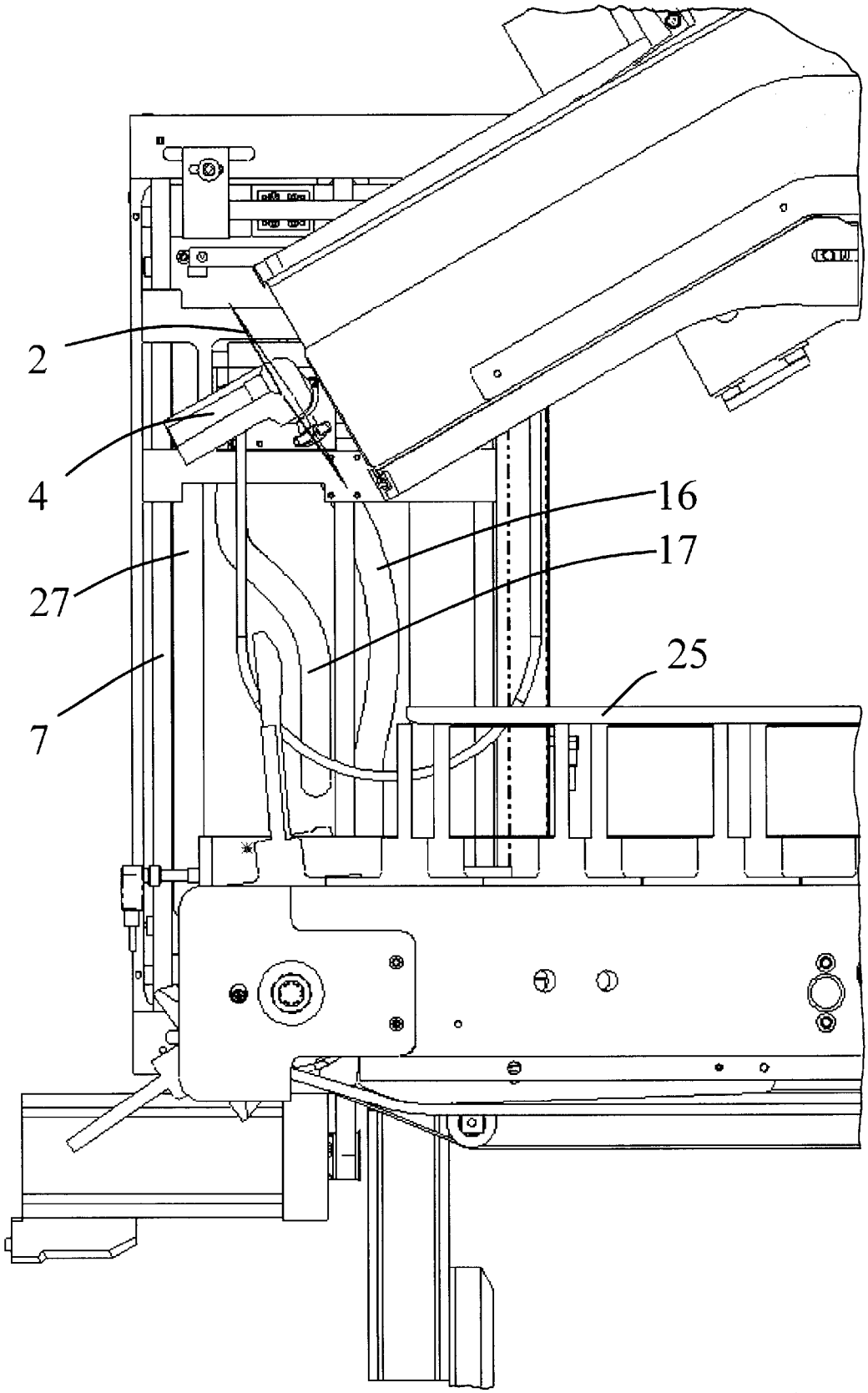

The system described above functions as follows:

Initially as shown in FIGS. 7 and 14 the suction grippers 3 are pressed flat against the frontmost carton 2 in the magazine 1 and suction is applied through them by an unillustrated vacuum line operated by an unillustrated controller. In this position the follower rollers 14 and 5 are at or close to the tops of their guide tracks 16 and 17 in the perfectly vertical upper portions thereof. Then as shown in FIGS. 8 and 15 the grippers 3 are moved simultaneously backward in direction B and downward in direction D by the motors 21 and 23 so that the resultant vector is perfectly parallel to the angled orientation of the magazine 1. This action therefore pulls the frontmost carton 2 straight out of the magazine 1.

Figure 9:
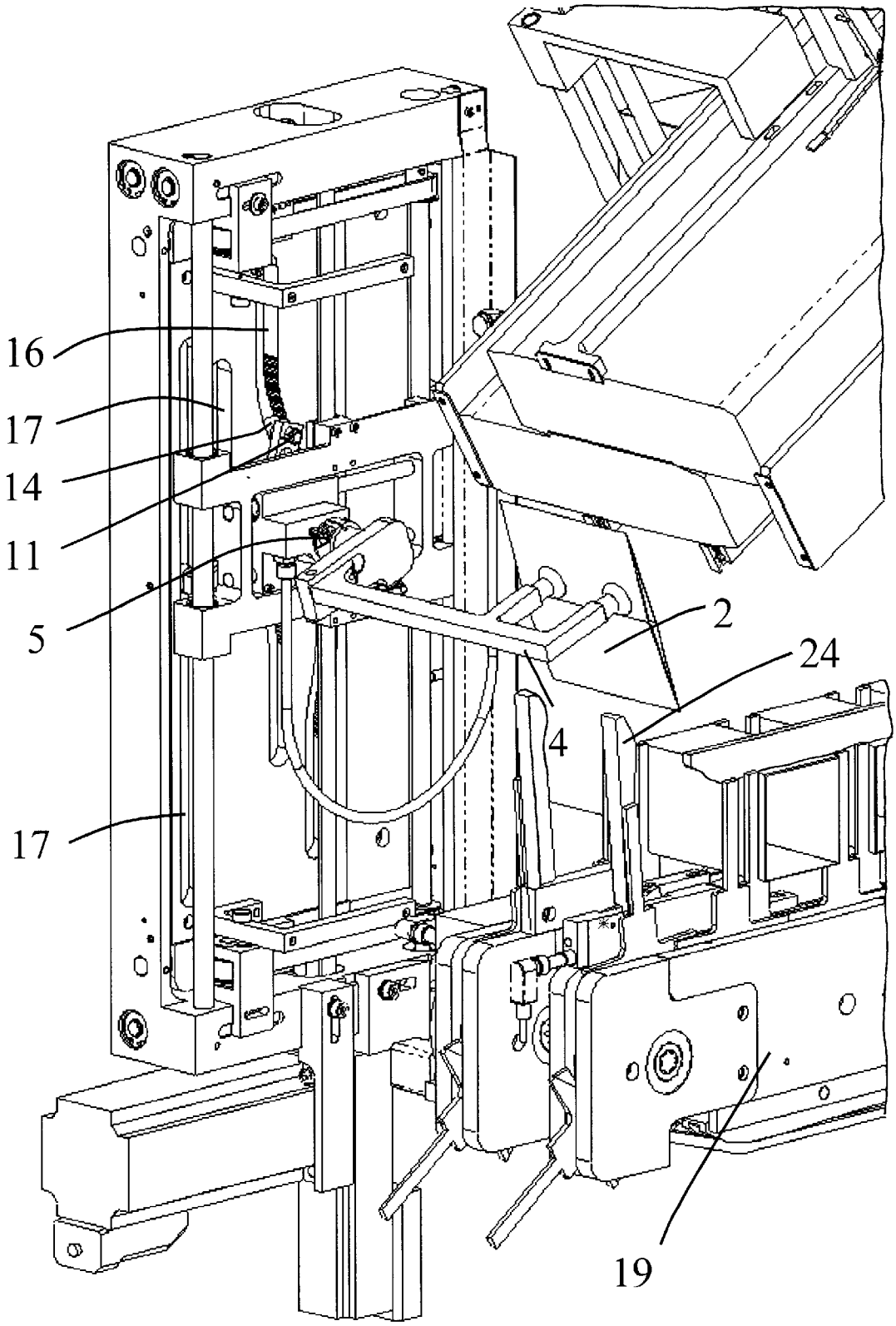
Figure 10:
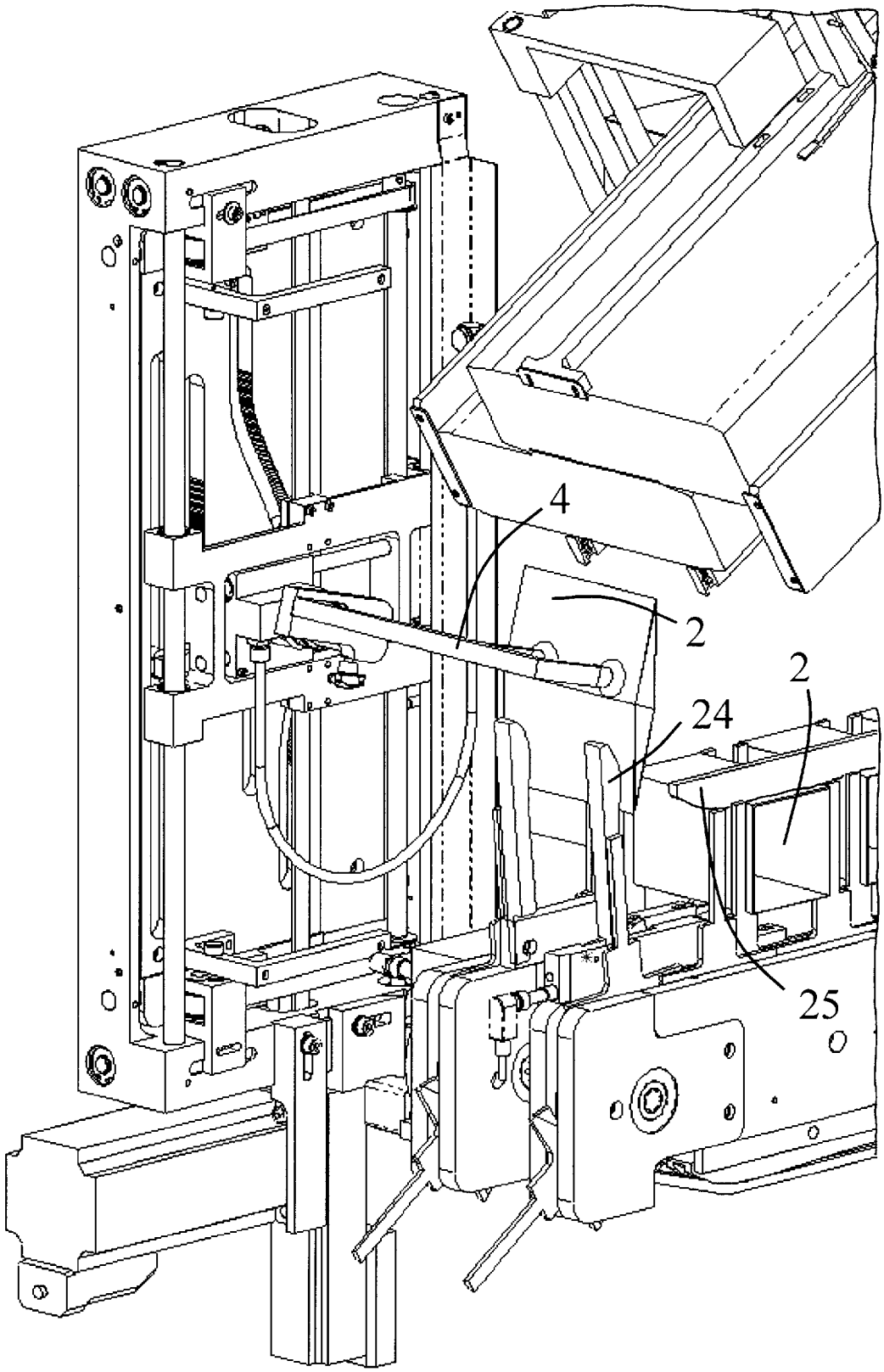
Figure 11:
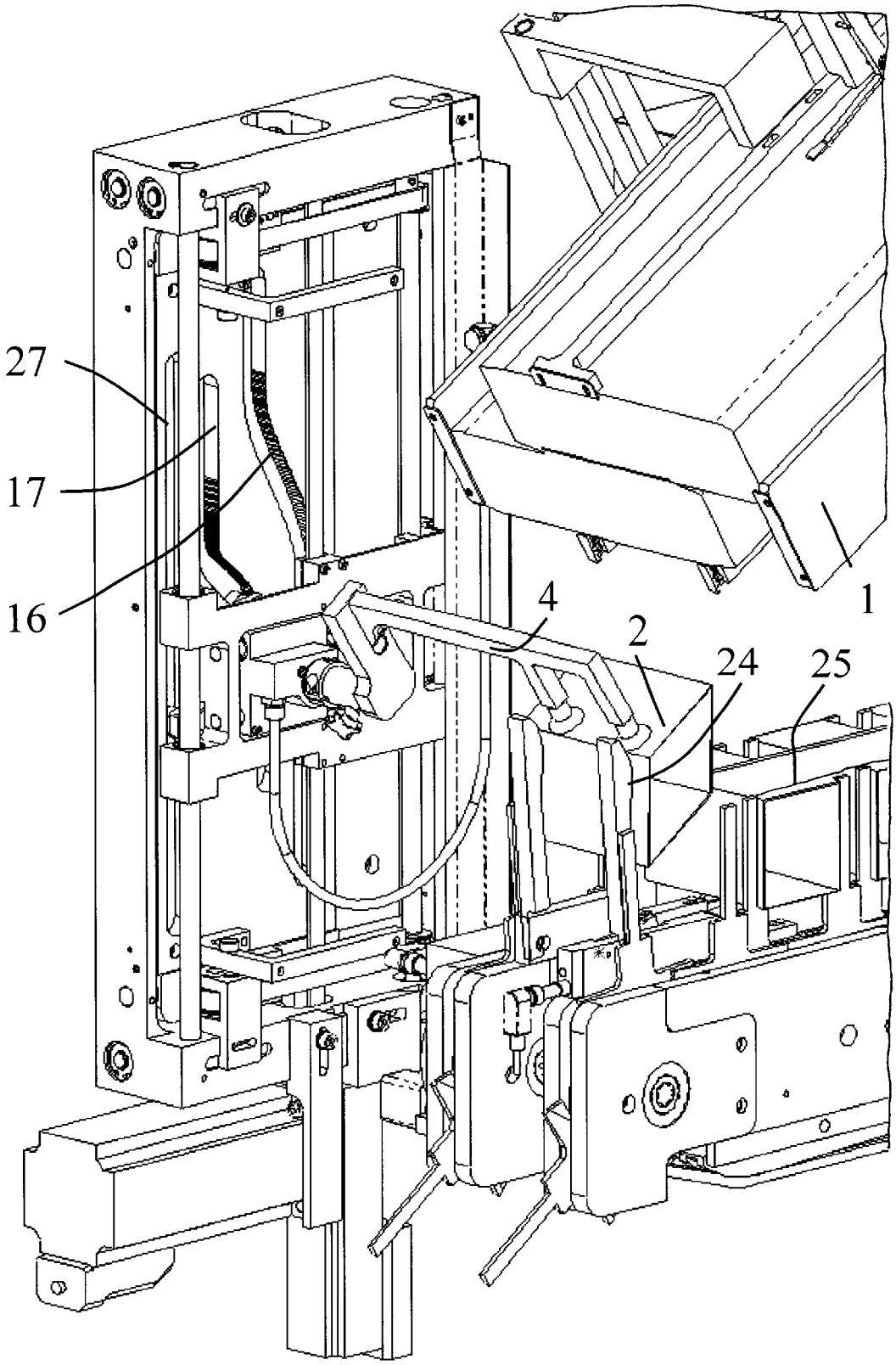
Figure 12:
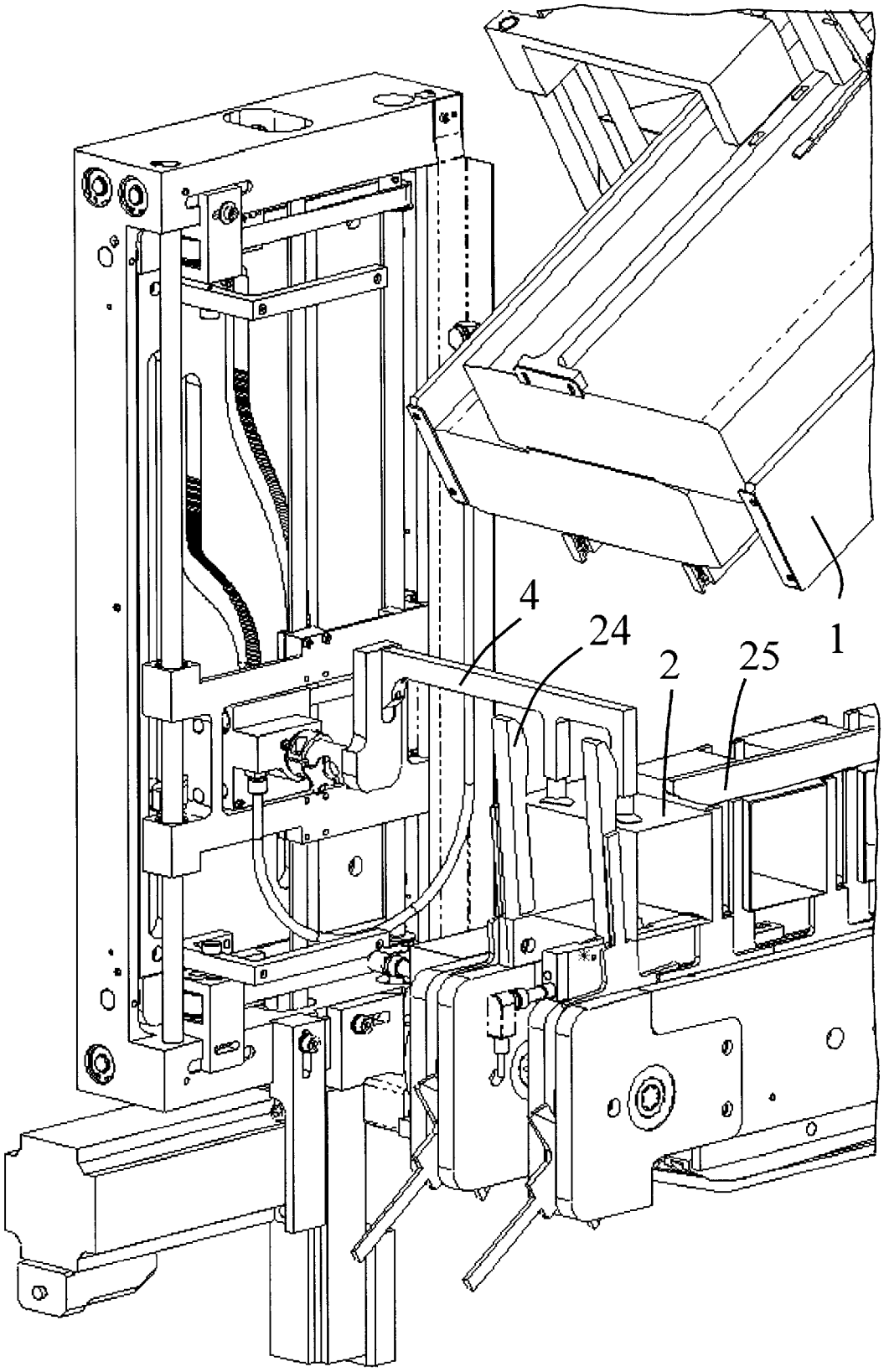
Figure 16:
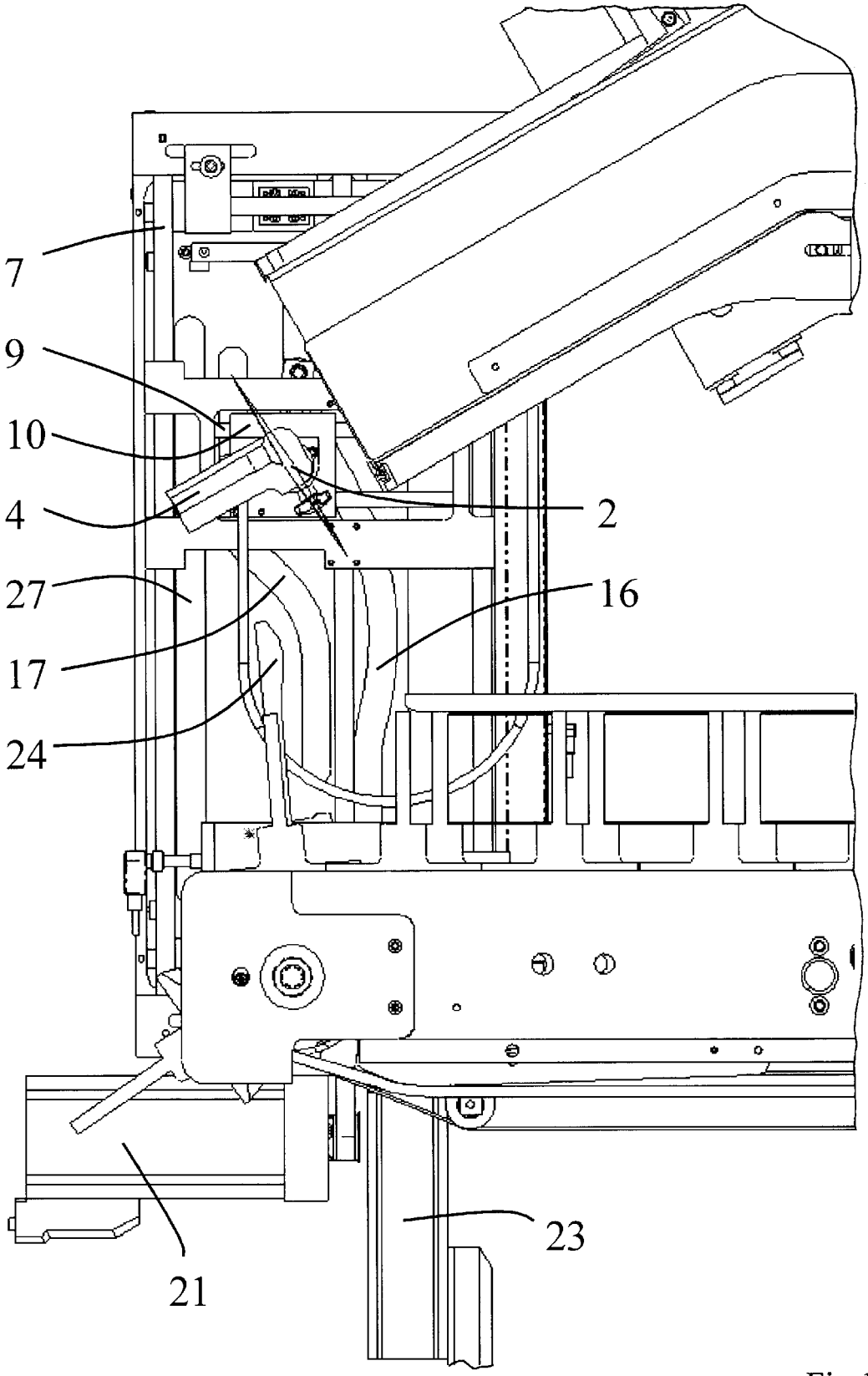
Figure 17:
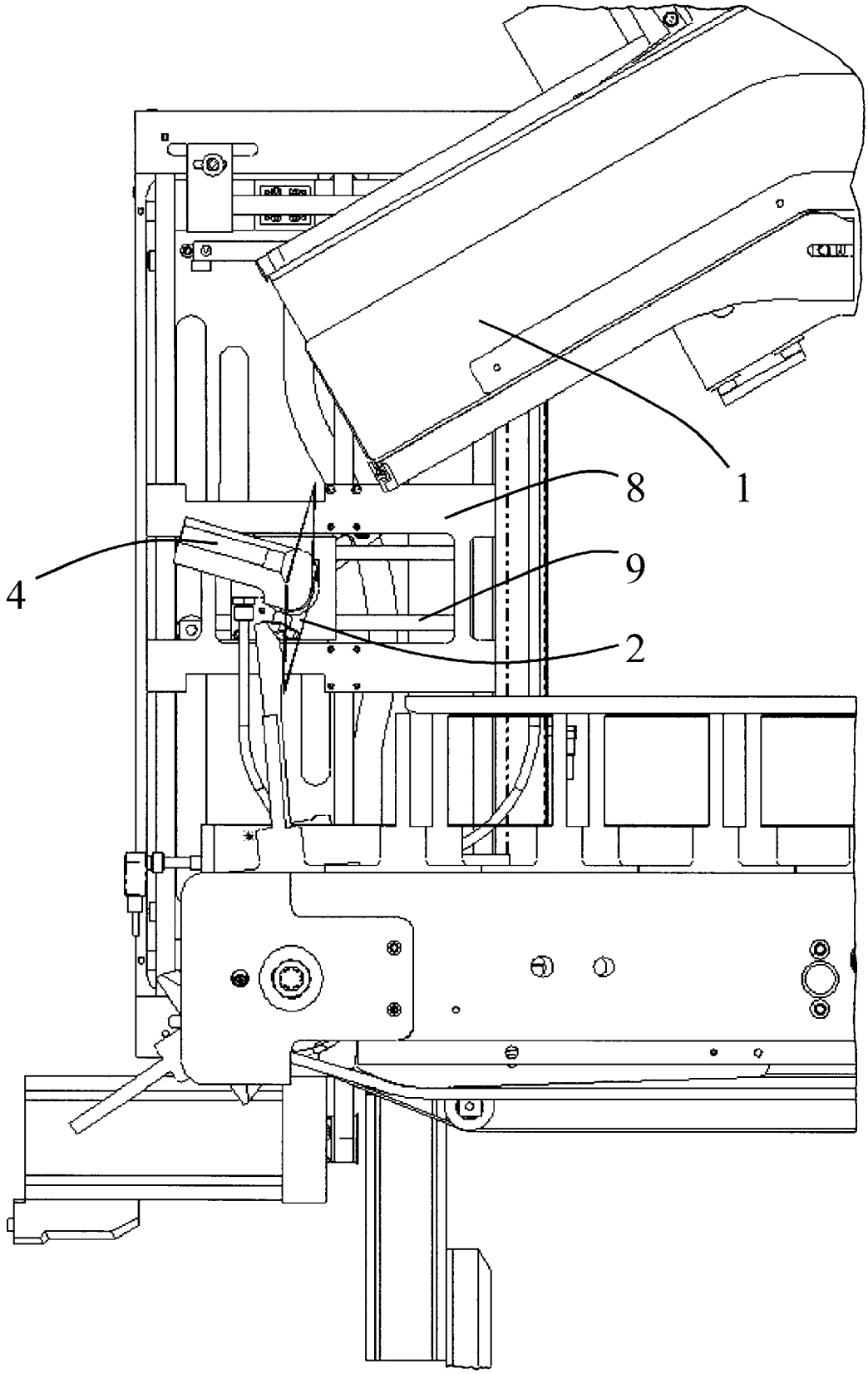
Figure 18:
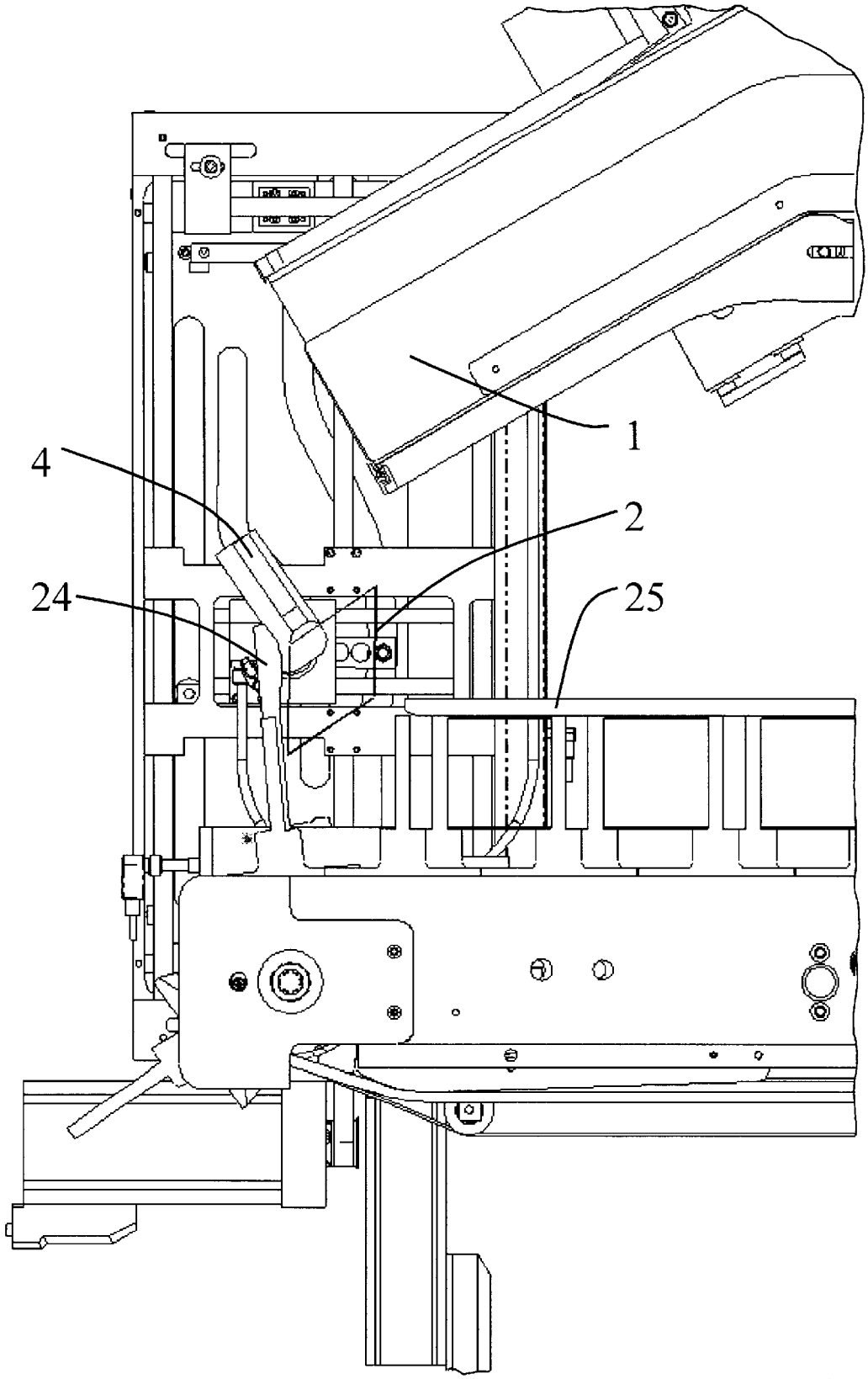
Figure 19:
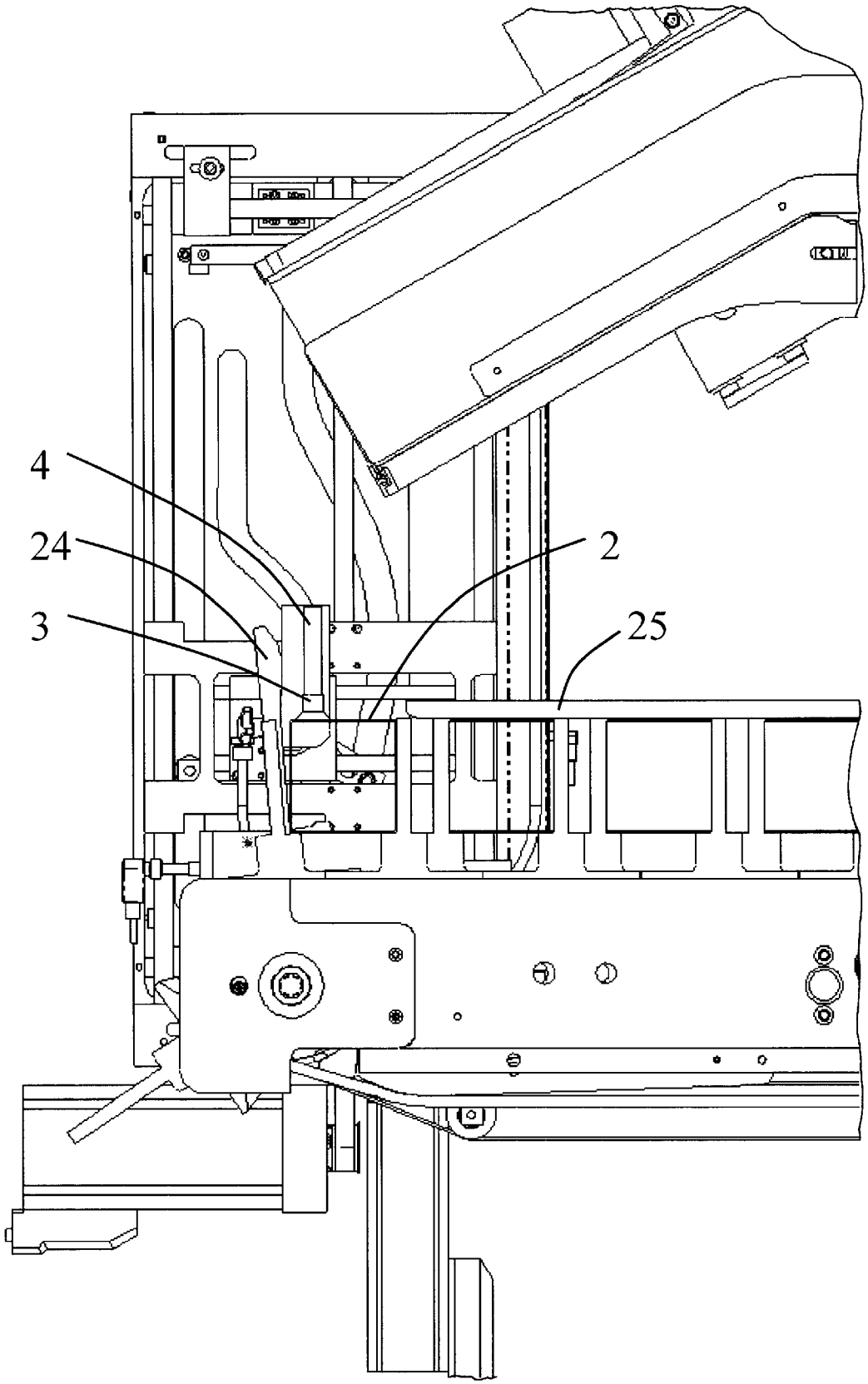

On further movement downward of the subassembly 6 the first follower 14 enters the curved part of its track 16 and starts to pivot the shaft about the axis A rapidly in a clockwise direction through about 45° and then the second follower 15 takes over for pivoting through another 75° as shown in FIGS. 9 and 16. During this movement the flattened carton 2, which might be opened up a little as it is pulled from the magazine 1, is brought into engagement with the abutment arms 24 so that, on further pivoting as shown, in FIGS. 10, 11, 17, and 18, the carton 2 is opened up and eventually set in fully erect condition as shown in FIGS. 12 and 19 on the conveyor 19.

Figure 13:
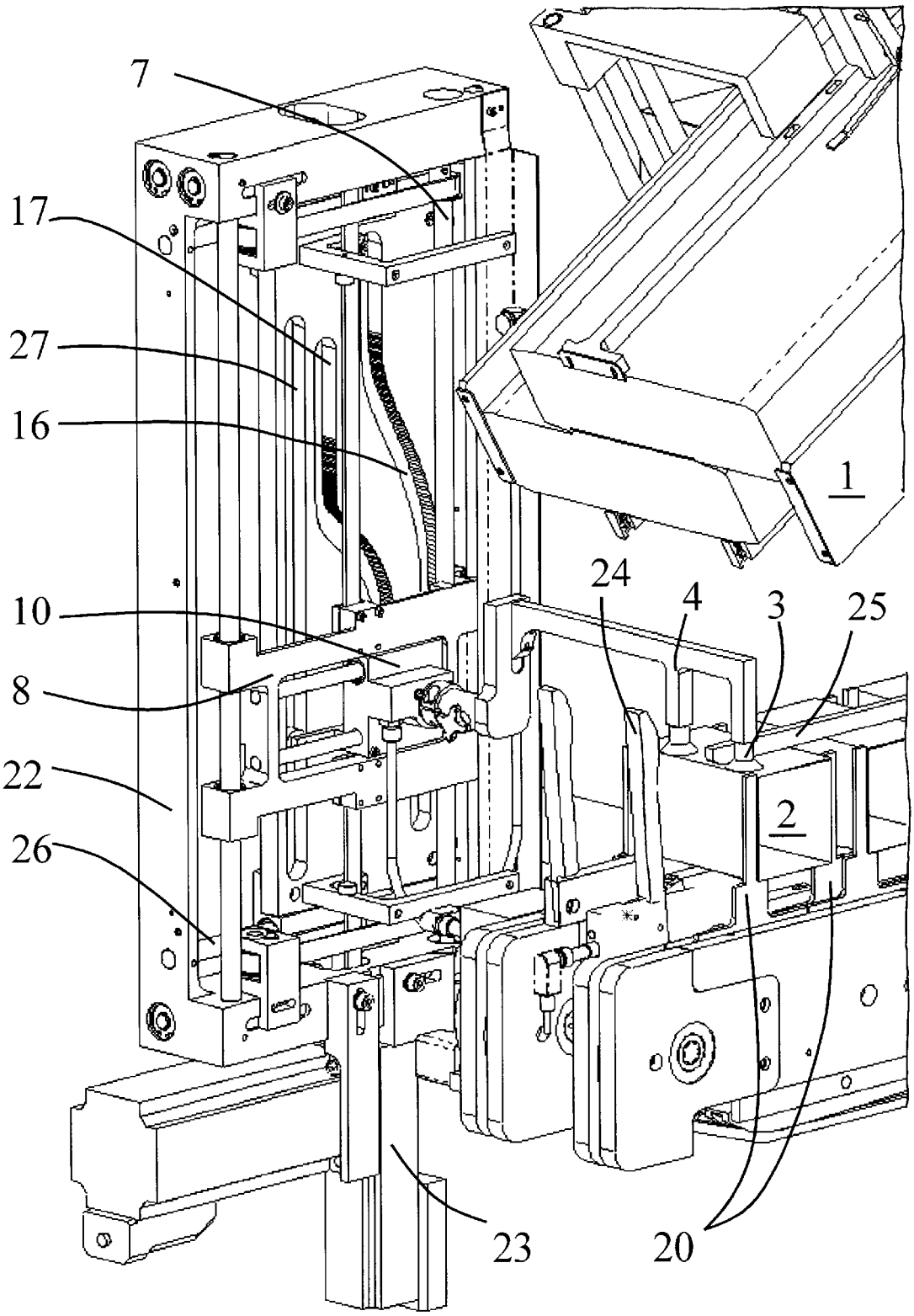
Figure 20:
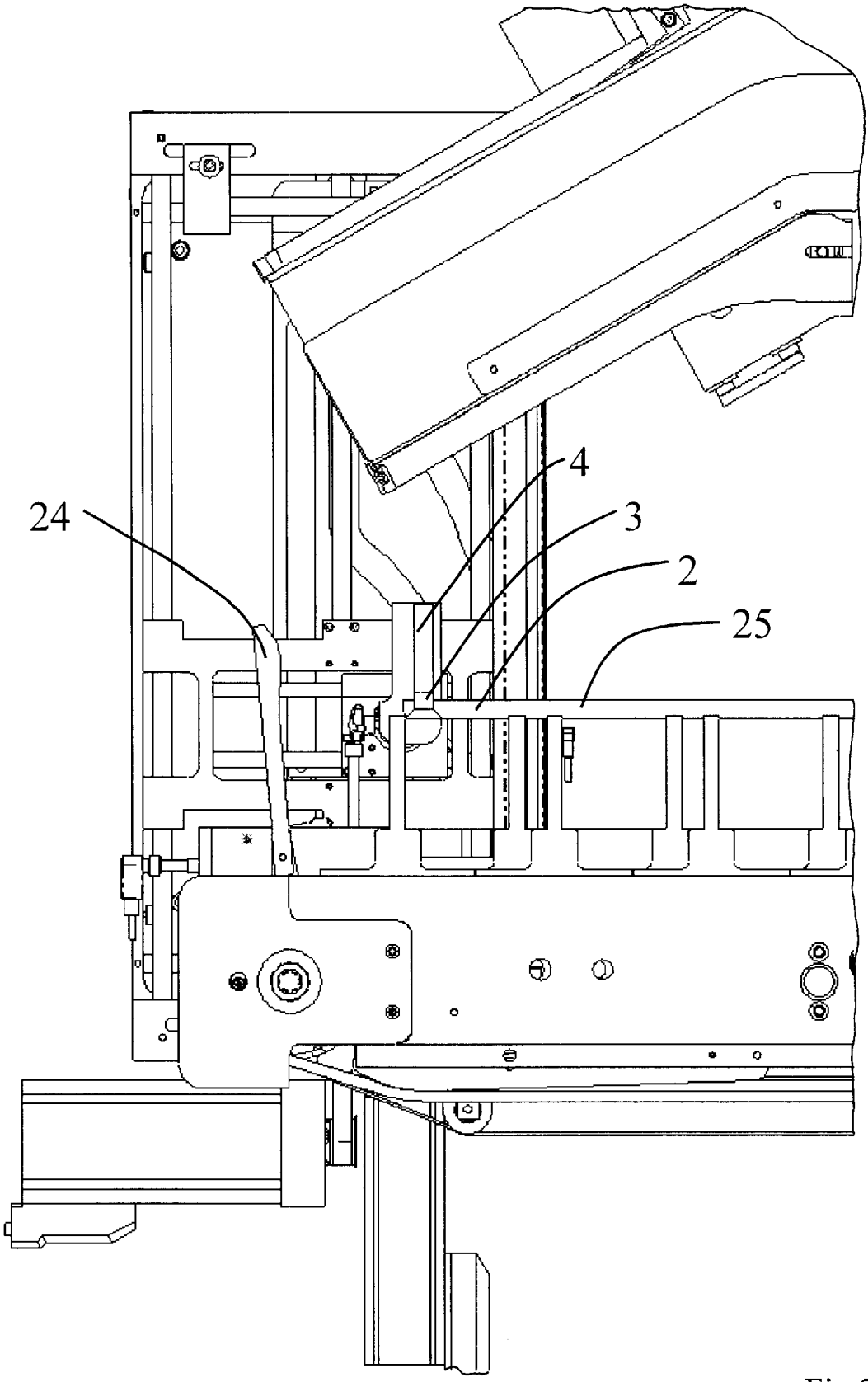

Then the drive 23 again displaces the slides 22 and 10 forward in the direction F to move synchronously with the conveyor 19 and slide the opened carton 2 underneath the guides 25 which maintain it open as shown in FIGS. 13 and 20. Once the carton 2 is caught underneath the guides 25, the grippers 3 release and the equipment is moved back into the position of FIGS. 7 and 14.

Thus this system can work with a downwardly directed is magazine 1, pivoting the cartons 2 through a substantial angle, here 120° with ease. On change of format all that needs to be varied is the upper and lower end positions reached by the vertical slide 6, something largely the domain of the drive motor 21 which is typically of the stepping type and operated by a computer-type controller also connected to the drive 21 and the conveyor 19.

We claim:

1. In combination with a magazine holding a stack of flattened cartons with the cartons extending in respective parallel and generally vertical planes and the stack having an end formed by a frontmost carton, and a conveyor below the magazine and adapted to carry off erected cartons in a forward transport direction, an unloading and erecting apparatus comprising:

a frame fixed to the magazine adjacent the conveyor;

an outer horizontal guide on the frame;

an outer horizontal slide horizontally displaceable on the outer horizontal guide in the forward direction and in an opposite backward direction and carrying two differently shaped and nonstraight outer vertical guides;

drive means including a motor connected to the outer horizontal slide for horizontally displacing same on the outer horizontal guide;

a vertical guide on the frame;

a vertical slide vertically displaceable on the vertical frame guide in an upward direction and in an opposite downward direction;

drive means including another motor connected to the vertical slide for vertically displacing same on the vertical frame guide;

a shaft pivotal about a generally horizontal axis transverse to the forward direction on the vertical slide and fixed horizontally relative to the outer horizontal slide;

a gripper fixed on and angularly displaceable with the shaft and engageable with the frontmost carton; and means including a lever on the shaft angularly coupled to the gripper and having offset from the axis two respective followers engaged in the vertical guides of the outer slide for, on vertical movement of the vertical slide, pivoting the gripper between a pick-off position engageable with the frontmost carton and a drop-off position directed downwardly above the conveyor.

2. The carton-unloading and -erecting apparatus defined in claim 1 wherein the nonstraight outer vertical guides are shaped such that on vertical movement of the vertical slide the followers are alternately effective to pivot the shaft.

3. The carton-unloading and -erecting apparatus defined in claim 1 wherein the magazine is angled downward at an acute angle to the horizontal and the forward direction is horizontal, the shaft pivoting through more than 90° on movement between the take-off position and drop-off position.

4. The carton-unloading and -erecting apparatus defined in claim 1, further comprising:

an inner horizontal guide on the vertical slide;

an inner horizontal slide horizontally displaceable on the inner horizontal guide in the forward and backward directions relative to the vertical slide; and link means coupling the inner and outer horizontal slides together for joint horizontal movement.

5. The carton-unloading and -erecting apparatus defined in claim 1, further comprising a stationary abutment underneath the magazine at an upstream end of the conveyor and positioned to engage a carton moved by the gripper between the take-off position and the drop-off position.

6. The carton-unloading and -erecting apparatus defined in claim 1, further comprising a horizontal hold-down guide extending above the conveyor downstream of an upper end thereof, whereby cartons on the conveyor are held down thereagainst by the hold-down guide.

7. The carton-unloading and -erecting apparatus defined in claim 1 wherein each of the nonstraight vertical guides has a vertical and straight lower section.

8. The carton-unloading and -erecting apparatus defined in claim 7 wherein each of the nonstraight vertical guides has a vertical and straight upper section.

9. In combination with a magazine holding a stack of flattened cartons with the cartons extending in respective parallel and generally vertical planes and the stack having an end formed by a frontmost carton, and a conveyor below the magazine and adapted to carry off erected cartons in a forward transport direction, an unloading and erecting apparatus comprising:

a frame fixed to the magazine adjacent the conveyor;

an outer horizontal guide on the frame;

an outer horizontal slide horizontally displaceable on the outer horizontal guide in the forward direction and in an opposite backward direction and carrying a nonstraight outer vertical guide;

drive means including a motor connected to the outer horizontal slide for horizontally displacing same on the outer horizontal guide;

a vertical guide on the frame;

a vertical slide vertically displaceable on the vertical frame guide in an upward direction and in an opposite downward direction;

drive means including another motor connected to the vertical slide for vertically displacing same on the vertical frame guide;

a shaft pivotal about a generally horizontal axis transverse to the forward direction on the vertical slide and fixed horizontally relative to the outer horizontal slide;

a gripper fixed on and angularly displaceable with the shaft and engageable with the frontmost carton; and means including a lever on the shaft angularly coupled to the gripper and having offset from the axis a follower engaged in the vertical guide of the outer slide for, on vertical movement of the vertical slide, pivoting the gripper between a pick-off position engageable with the frontmost carton and a drop-off position directed downwardly above the conveyor.

* * * * *